US005246480A

United States Patent [19]

Haufe et al.

[11] Patent Number: 5,246,480

[45] Date of Patent: Sep. 21, 1993

[54] SINTERED CONTACT MATERIAL BASED ON SILVER FOR USE IN POWER ENGINEERING SWITCH-GEAR, IN PARTICULAR FOR CONTACT PIECES IN LOW-VOLTAGE SWITCHES

[75] Inventors: Wolfgang Haufe, Hessdorf; Joachim Grosse, Erlangen; Bernhard Rothkegel, deceased, late of Nuremberg, all of Fed. Rep. of Germany, by Rita G. Rothkegel, Bianca Rothkegel, Matthias Rothkegel, heirs

[73] Assignee: Siemens Aktiengesellschaft, München, Fed. Rep. of Germany

[21] Appl. No.: 582,871

[22] PCT Filed: Apr. 19, 1989

[86] PCT No.: PCT/DE89/00239

§ 371 Date: Oct. 17, 1990

§ 102(e) Date: Oct. 17, 1990

[87] PCT Pub. No.: WO89/10417

PCT Pub. Date: Nov. 2, 1989

[51] Int. Cl.[5] ..... C22C 29/02

[52] U.S. Cl. ..... 75/236; 75/238; 75/239; 75/244; 75/247; 252/514; 252/516; 252/519; 252/520; 420/501

[58] Field of Search ..... 75/236, 238, 239, 244, 75/247; 252/514, 519, 520, 516; 420/501

[56] References Cited

U.S. PATENT DOCUMENTS

| | | | |
|---|---|---|---|
| 1,984,203 | 12/1934 | Sieger | 428/569 |
| 3,225,169 | 12/1965 | Kosco | 200/264 |
| 3,482,950 | 12/1969 | Kosco | 75/236 |
| 3,950,165 | 4/1976 | Oda et al. | 75/200 |
| 3,992,199 | 11/1976 | Neely | 75/200 |
| 4,137,076 | 1/1979 | Hoyer et al. | 75/241 |
| 4,424,429 | 1/1984 | Yamanaka et al. | 200/264 |
| 4,673,550 | 6/1987 | Dallaire et al. | 419/12 |
| 4,743,718 | 5/1988 | Somtilli | 200/144 B |
| 4,859,238 | 8/1989 | Weise et al. | 75/233 |

OTHER PUBLICATIONS

Patent Abstracts of Japan, vol. 7, No. 77 (C-159) [4222], Mar. 30, 1983, corresponding to JP 58-9952.

Patent Abstracts of Japan, vol. 11, No. 273 (C-445)[2720], Sep. 4, 1987, corresponding to JP 62-77439.

Int. J. of Powder Metallurgy And Powder Technology, vol. 12, No. 3, pp. 219-228, Jul., 1976, "Properties of P/M Electrical Contact Materials" by H. Schriner et al.

*Primary Examiner*—Peter A. Nelson
*Assistant Examiner*—Ngoclan T. Mai
*Attorney, Agent, or Firm*—Kenyon & Kenyon

[57] ABSTRACT

In a contact material, there is present in addition to silver, at least one higher melting point metal, metal alloy or metal compound. According to the invention, the material contains in addition to silver (Ag), at least iron (Fe) and/or titanium (Ti) in percent by weight of from 2 to 50%. Optionally, nitrides, carbides and/or borides of the metals titanium, zirconium and/or tantalum may also e present. It has been found that in their contact property spectrum such materials are largely equivalent to the material AgNi10. Thus the latter contact material can be replaced completely.

8 Claims, No Drawings

SINTERED CONTACT MATERIAL BASED ON SILVER FOR USE IN POWER ENGINEERING SWITCH-GEAR, IN PARTICULAR FOR CONTACT PIECES IN LOW-VOLTAGE SWITCHES

The present invention relates to a silver-based sintered contact material for use in switch-gears of the energy technology, and in particular for contact pieces in low-voltage switches, which contain in addition to silver, at least one higher melting point metal, metal alloy and/or a metal compound as an active component. Switch-gear of the energy technology is understood in the present instance as exclusively air switch-gear.

For contact pieces in low-voltage switch-gears of the energy technology, e.g., in power switches, as well as in DC and auxiliary contactors, contact materials of the silver-metal (AgMe) system have long proved successful. In the past, the silver-nickel (AgNi) system has had a major share of these contact materials. The advantageous properties of silver-nickel in contact systems are known and have been described together with the testing methods for contact materials, for example, in Int. J. Powder Metallurgy and Powder Technology, Vol. 12 (1976), pp 219–228.

Some time ago, however, it was found that nickel dust has carcinogenic effects. For this reason, endeavors have been under way for some time to replace the nickel by another metal or a metal alloy or metal compound. These new materials, however, must have a similar spectrum of contact properties as compared to AgNi materials.

It is, therefore, the object of the invention to provide a contact material of the initially mentioned kind wherein nickel as active component is replaced by a metal, metal alloy or metal compound without diminishing the contact properties.

According to the invention, the problem is solved by providing a contact material which contains in addition to silver (Ag), as an active component at least iron (Fe) and/or titanium (Ti). The active component may be present in the material in percentages by mass or weight of up to 50%.

In accordance with the invention, iron or titanium alone may be present in combination with silver. Preferably, the iron and the titanium are present in alloyed form. In particular, in the composition close to 50 atom-% (46 wt-% Ti) iron and titanium form an intermetallic phase in which the properties supplement each other ideally.

As a development of the invention, the contact material may additionally contain as further active components nitrides and/or carbides and/or borides of metals. In particular, titanium enters into consideration for this, but zirconium or tantalum may also be used. The nitrides and/or carbides and/or borides of the metal may have a mass or weight percentage of from 1 to 50% with reference to the iron-titanium content as the main active component. With the nitrides, carbides and/or borides, the proportion of the base constituents can be increased, i.e. the necessary proportion of silver may be reduced. As a whole, the material may contain the base constituents in percentages by weight up to at least 50%.

All active components are present in the contact material in a proportion in percent by volume of between 2% and 50%. In various embodiments of the present invention, the proportion of all active components is suitably less than 40%, less than 30%, or less than 20%.

Further details and advantages of the invention will become evident from the following description of an embodiment example for the production of contact pieces, with reference also being made to the attached table with specific examples for different materials compositions according to the invention.

The table lists measured values for the maximum welding force in N, for the volume burnoff in $mm^3$, and for the contact resistance in m. These measured values characterize, in combination, the property spectrum of the particular contact material, wherein especially the volume burnoff is a significant measure for the possible number of switching operations of the contact, i.e., the life of the contact piece, and the contact resistance is a significant measure for the overtemperature at the contact piece. The values are compared in each instance with the measured values for AgNi10.

For the preparation of the contact material, first, a powder mixture is prepared by wet mixing with commercial silver powder and iron or titanium powder or FeTi alloy powder and the powders of the additional components. The maximum particle size of the powders is approximately 25 μm. From the powder mixture, shaped parts are pressed at a pressure of 200 MPa to form contact pieces. For reliable union of the contact piece with the contact piece holder by brazing, it may be advantageous in this pressing operation to press a second layer of pure silver jointly with the contact layer to form a two-layer contact piece.

Sintering of the shaped parts occurs at a temperature of about 850° C. for about one hour under vacuum or under shield gas. To obtain minimum porosity, the sintered bodies are subsequently re-pressed at a pressure of 1000 MPa and again sintered at 650° C. for about one hour under vacuum or under shield gas. Calibration of the contact piece thus produced is done again at a pressure of 1000 MPa.

As an alternative to the shaped-part technology, contact pieces can be produced by first fabricating the contact material by extrusion into strips or wires. From this semi-finished product, contact pieces with an oriented structure can then be cut.

In test series not only pure Fe powder or Ti powder but in particular iron-titanium alloy powders were used. Optimum properties occur with a FeTi46 alloy, in which the iron and titanium form the intermetallic phase FeTi. Here in particular the titanium counteracts the corrosion tendency of iron, which could otherwise have adverse effects on the iron in the course of a prolonged life of the contact piece.

In the examples, the composition of the active component was selected predominantly so that there is approximately obtained a volume percentage corresponding to the nickel in the material AgNi10.

In additional examples, titanium nitrides and/or titanium carbides are added to the FeTi46 alloy. Their mass or weight percentages are chosen so that with reference to the iron-titanium content, they are between 1 and 50%. On the whole, care is taken in the examples that the material contains at most 50% base constituents by weight.

In a test switch, the welding force, the volume burnoff, and the contact resistance were determined in known manner over a switching cycle of 500 on the contact pieces produced as specified above from the stated materials, under constant testing conditions at a current at make of 1000 A and a current at break of 100 A. The results are compiled in the table and are compared with the measured values of a conventional AgNi10 material.

The table shows that in all examples, the maximum welding force is not higher than that for the known AgNi10 comparison material The volume burnoff, on the other hand, is, by and large, below that of the comparison material. The contact resistance is on the same order of magnitude, or sometimes the values are higher.

But on the whole, the spectrum of contact properties resulting from the combination of the individual values demonstrates values comparable with AgNi10. The stated contact materials, therefore, can replace the AgNi materials, so that now the carcinogenic nickel can be dispensed with entirely.

In additional examples, borides are also used as supplementary active components besides the above stated metal compounds. In particular, good properties can be expected from zirconium or tantalum borides, and it is possible to combine borides with carbides and/or nitrides.

TABLE

| Ex. No. | Composition | Max welding force $Fs_{max}$ in N | Volume burnoff $\Delta V_{500}$ in $mm^3$ | Contact resistance $R_{k1}$ in mOhm |
|---|---|---|---|---|
| Comparison material | AgNi10 | 550 | 45 | 0.03 |
| | AgFe9 | 723 | 12 | 0.03 |
| | AgFe20 | 403 | 7 | 0.05 |
| | AgFe30 | 160 | 2 | 0.09 |
| 1 | Ag(FeTi20)7.9 | 297 | 21 | 0.05 |
| 2 | Ag(FeTi30)7.5 | 332 | 19 | 0.05 |
| 3 | AG(FeTi46)6.7 | 363 | 21 | 0.03 |
| 4 | AG(FeTi40)6.4 | 456 | 38 | 0.04 |
| 5 | Ag(TiFe30)7 | 626 | 33 | 0.05 |
| | AgTi5.3 | 846 | 23 | 0.05 |
| 6 | Ag(FeTi20)15 | 179 | 18 | 0.08 |
| 7 | Ag(FeTi46)5.6TiN1 | 250 | 17 | 0.04 |
| 8 | Ag(FeTi46)6TiCO.5 $ZrB_2$0.25 | 382 | 21 | 0.06 |
| 9 | Ag(FeTi46)5.5TaCO.5 | 351 | 27 | 0.04 |

We claim:

1. A silver based sintered contact material for use in energy technology switch-gear comprising silver and at least one active component which comprises metal, metal alloy and having a melting point higher than silver or metal compound, said contact material consisting essentially of:

a main active component being iron (Fe) and titanium (Ti) present in alloyed form;

a selective additional active component being at least one member selected from the group consisting of metal nitride, metal carbide, metal boride, and mixtures thereof;

all active components being present in the contact material in a proportion in percent by weight between 2% and 50%;

said additional active component comprising in percent by weight up to 50% with reference to the proportion of iron and titanium;

balance, silver.

2. A sintered contact material according to claim 1 wherein the proportion of all active components is less than 40%.

3. A sintered contact material according to claim 2 wherein the proportion of all active components is less than 30%.

4. Sintered contact material according to claim 3 wherein the proportion of all active components is less than 2%.

5. Sintered contact material according to claim 1 wherein iron (Fe) and titanium (Ti) are present with respect to one another in percent by weight of about 54% to 46% and form the intermetallic compound FeTi.

6. Sintered contact material according to claim 1 wherein the metal of the group consisting of metal nitride, metal carbide, and metal boride is titanium (Ti).

7. Sintered contact material according to claim 1 wherein the metal of the group consisting of metal nitride, metal carbide, and metal boride is zirconium (Zr).

8. Sintered contact material according to claim 1 wherein the metal of the group consisting of metal nitride, metal carbide, and metal boride is tantalum (Ta).

* * * * *